US007073235B2

(12) United States Patent
Benedict

(10) Patent No.: US 7,073,235 B2
(45) Date of Patent: Jul. 11, 2006

(54) NON-INERTIAL RELEASE SAFETY RESTRAINT BELT BUCKLE SYSTEMS

(76) Inventor: Charles E. Benedict, 3207 Remington Run, Tallahassee, FL (US) 32312

( * ) Notice: Subject to any disclaimer, the term of this patent is extended or adjusted under 35 U.S.C. 154(b) by 68 days.

(21) Appl. No.: 10/769,870

(22) Filed: Feb. 3, 2004

(65) Prior Publication Data

US 2004/0255439 A1 Dec. 23, 2004

Related U.S. Application Data

(63) Continuation-in-part of application No. 10/462,738, filed on Jun. 17, 2003, now abandoned.

(51) Int. Cl.
*A44B 11/25* (2006.01)

(52) U.S. Cl. ..... 24/633; 24/640; 24/664

(58) Field of Classification Search ..... 24/625, 24/629, 630, 633, 636, 642, 653, 656, 664, 24/640, 641; 280/801.1, 802–804; 297/270, 297/286, 468

See application file for complete search history.

(56) References Cited

U.S. PATENT DOCUMENTS 1,548,023 A * 8/1925 Cowell ..... 54/23
2,518,889 A * 8/1950 Henderson ..... 24/313
2,941,272 A 6/1960 Bourguignon
3,090,092 A * 5/1963 Szemplak et al. ..... 24/648
3,789,467 A * 2/1974 Aratani et al. ..... 24/648
4,307,494 A * 12/1981 Gasse et al. ..... 24/634
4,321,734 A * 3/1982 Gandelman ..... 24/648
4,587,695 A * 5/1986 Jensen ..... 24/634
4,625,371 A * 12/1986 Ueda ..... 24/641
5,142,748 A * 9/1992 Anthony et al. ..... 24/579.11
5,144,725 A * 9/1992 Krauss ..... 24/625
6,668,434 B1 * 12/2003 Casebolt et al. ..... 24/634
6,691,384 B1 * 2/2004 Glasa ..... 24/633
6,694,578 B1 * 2/2004 Nicoll ..... 24/645

* cited by examiner

*Primary Examiner*—Robert J. Sandy
*Assistant Examiner*—André L. Jackson
(74) *Attorney, Agent, or Firm*—Dowell & Dowell, P.C.

(57) ABSTRACT

Vehicle body restraint systems including buckles for latching and retaining latch plates associated with safety belts wherein the buckles includes latching mechanisms having oppositely oriented release mechanisms which are operative in such a manner that any force applied to one release mechanism which would act to release a latch plate creates an increased force on the opposing release mechanism to retain the latch plate in a locked position. Release of the latch plates can only occur upon the simultaneous activation of the opposing release mechanisms by manual force applied in opposite directions.

19 Claims, 8 Drawing Sheets

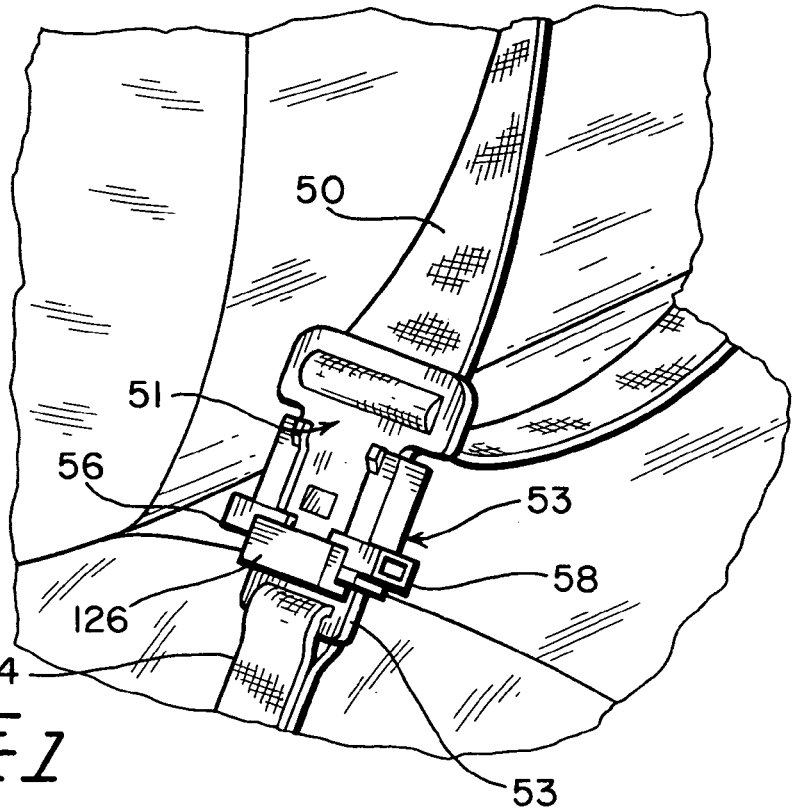
FIG. 1
FIG. 2
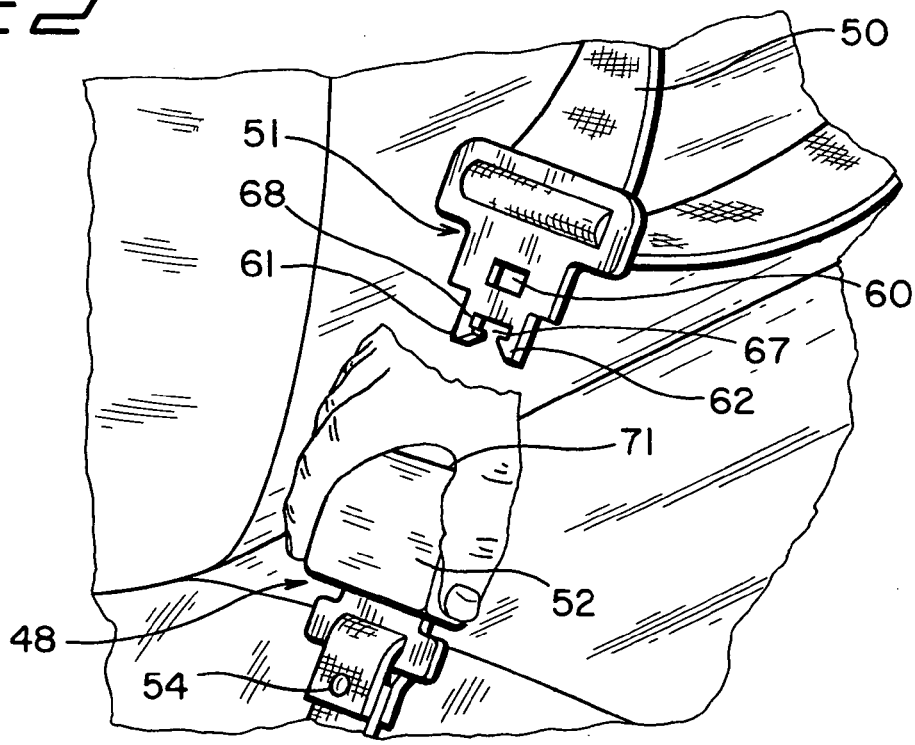

FIG. 24
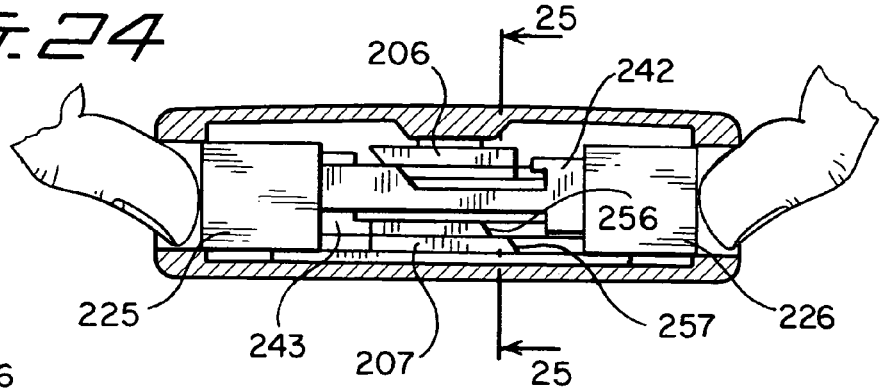
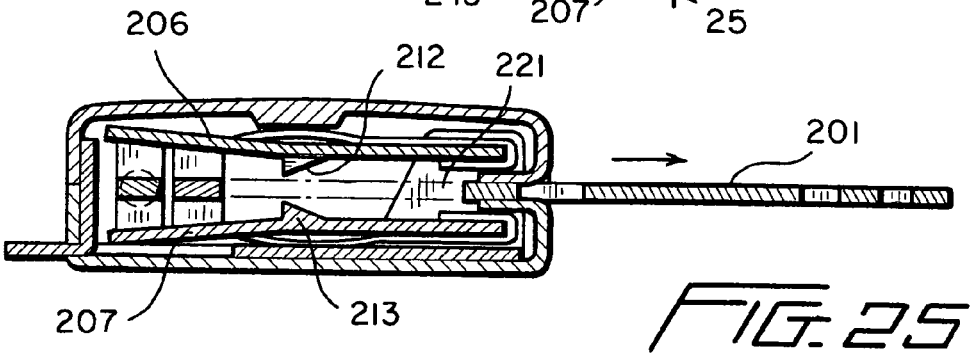
FIG. 25
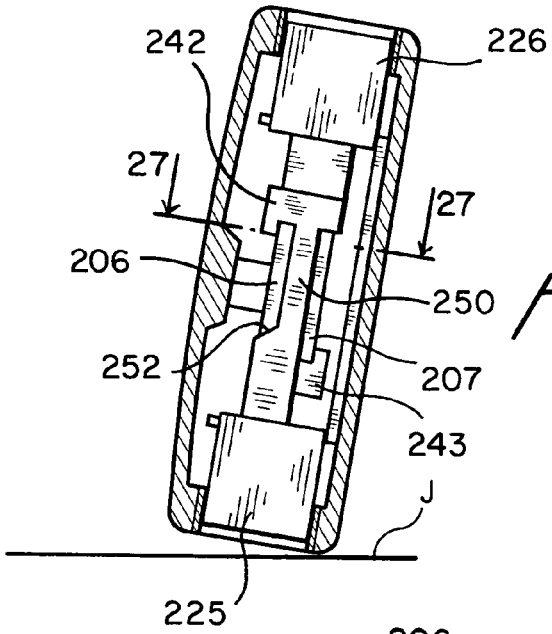
FIG. 26
FIG. 27
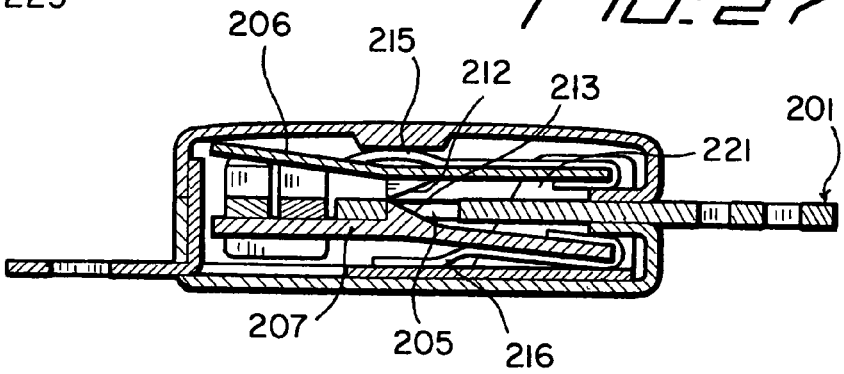

NON-INERTIAL RELEASE SAFETY RESTRAINT BELT BUCKLE SYSTEMS

This application is a Continuation-in-Part of Application Ser. No. 10/462,738, filed Jun. 17, 2003, entitled NON-INERTIAL SAFETY RESTRAINT BELT BUCKLE SYSTEM, in the name of the same inventor, now abandoned.

FIELD OF THE INVENTION

This invention is generally directed to vehicle safety restraint systems including shoulder and lap-type seat belts and more particularly to such restraint systems which incorporate locking mechanisms for preventing release of latch plates from buckles of the restraint systems due to inertial forces created during vehicle accidents, such as in vehicle rollovers. The restraint systems can only be released by simultaneously manually maneuvering opposing release mechanisms in opposite directions.

BRIEF DISCUSSION OF THE RELATED ART

Body restraint systems including seat belts, lap belts, shoulder harnesses and the like have been credited with saving numerous lives which otherwise would have been lost in vehicular accidents. The positive benefits obtained due to body restraints systems has been so recognized that, in the United States, the use of seat belts is mandated in all states.

Since their inception, there have been numerous innovative advances made to improve upon the safety and reliability of vehicle body restraint systems. Improvements have been made to the belt and belt materials, the manner in which the belt restraint systems are mounted within vehicles, the manner in which such restraint systems may be automatically adjusted to provide proper tension to suit not only safety standards but to also provide for a measure of passenger comfort and, further, to improve upon the security of the locking devices and belt buckles associated with such systems.

Most conventional vehicle body restraint systems incorporate a belt which either crosses in front of the lap or diagonally across the body of the vehicle operator or passenger in such a manner as to not adversely interfere with a region of an individual's neck. Belts are retained by latching assemblies including belt buckles into which latch plates carried by the belts can be inserted so as to automatically become locked to the buckles which are normally anchored relative to vehicle frames.

Conventional systems generally utilize two types of release mechanisms for allowing latch plates to be removed from buckle housings such that drivers and passengers can disembark vehicles. A first or side release system includes an operating release button which is generally resiliently urged outwardly at an angle which is perpendicular to an axis or line of insertion of the latch plate into a buckle housing. A second type of conventional release system is known as an end release system and includes an operating lever or button for releasing the latch plate from the buckle housing and which lever is mounted at an end of the buckle housing.

Currently, virtually all types of latching mechanisms for body restraint systems in automotive vehicles are subject to premature release when subjected to at least one mode of inertial force which is created under various conditions resulting from collisions, rollovers and other types of loss of vehicle control. Side release latching assemblies or mechanisms, referred to as Type 1 and Type 6 in the industry, will inertially release when subjected to lateral forces which are applied to a backside of a buckle during a vehicle collision or rollover. Such latching assemblies will also release by the release buttons being forceably engaged by an object in a vehicle accidently depressing the buttons during an accident, collision or rollover, thereby prematurely destroying the effectiveness of the restraint systems which can cause severe or deadly injury to persons using the systems.

By way of example, if a person's hip strikes the backside of a buckle frame, the interior latch will engage a latch plate of a seat belt and will release when the striking force level is sufficient to cause the inertia of the latch mass, relative to the acceleration and displacement of the buckle frame, to compress a leaf spring and unlatch the buckle.

End type release latching systems will inertially release due to the mass of the release buttons associated therewith when taken into consideration the mass of movement of latch plates and the direction of rotational release of the latch plates when subjected to an upward or upward and lateral force opposite a locking direction of latch dogs associated with such mechanisms, especially during vehicle rollovers. This lateral mode of failure occurs when an occupant is more apt to be ejected from a vehicle and thus can result in severe bodily injury or death.

An example of end release latching system for seat belts is disclosed in U.S. Pat. No. 4,358,879 to Magyar. The system uses a release button which is pushed down to release the latch plate as opposed to being pushed laterally as in the side release systems.

Virtually all end release buckles, generally referred to as Type II buckles, operate using an over-the-center mechanism so the actual latch uses either a fairly weak compression spring or a leaf spring for a latching force. A so called "lock for the latch" is a rod or bar that follows an "L" shaped track where the lock bar moves laterally across the buckle frame in a direction of latch movement and then moves vertically along a leg of the "L" and behind the latch after the latch goes over-the-center to its latched position; thus supposedly locking the latch from moving laterally due to lateral forces acting on the buckle frame that would inertially move the latch laterally relative to the buckle frame.

However, the end release buckles have a release button, release slider, lock bar (pin) latch and two compression springs, all of which have mass. One spring actuates the latch laterally and the other spring acts against the latch plate to keep a locking edge in contact with a latch surface or "dog" and applies an upward force against the release button. This spring also acts to eject the latch plate from the buckle when the latch button is depressed and the latch is disengage.

When vertical forces, or forces with enough vertical component on a buckle, such as forces created by impacts to a bottom of a vehicle in a rollover, are sufficiently high enough, the buckle latch will release. The design of these buckles is such that release requires both a vertical (longitudinal) and horizontal (lateral) component in many cases because any vertically upward forces cause equally vertical downward inertial forces to the release button and related components, which causes them to move in a downward (release) direction due to their mass and acceleration relative to the buckle frame. When the components of the release mechanism approach an elbow of the locking "L" slot, the locking pin or bar follows the path of the slot and releases the latch and the compression spring against which these inertia forces are acting, and ejects the latch plate.

The forces acting on a latch plate/buckle assembly that create inertia forces in a release direction come from various and foreseeable sources and directions and always follow Newton's Law. Some of these are:

a) vertical to horizontal forces acting on a vehicle and thus a buckle assembly from impact to the ground during vehicle rollovers;

b) vertical to horizontal forces acting on a vehicle and thus on a buckle assembly from impact to the vehicle from another vehicle, fixed object or other movable object within a path of the vehicle;

c) vertical to horizontal forces acting on a buckle assembly by objects within a vehicle, such as occupants or loose objects;

d) vertical to horizontal forces acting on a buckle assembly from it being driven into objects within a vehicle, such as a center console between a driver and a passenger or between vehicle occupants; and e) vertical to horizontal forces acting on a latch plate and release mechanism mass from impulses resulting from emergency management loop release as well as harness mounted air bags and the like where tension or a harness/lap belt webbing is suddenly tightened or released causing a large, near longitudinal impulse force into the buckle, latch plate and release mechanism mass sufficient to cause an acceleration of the mass of the release mechanism parts to develop an inertia force exceeding a release mechanism spring force acting against a release mechanism mass.

A latch plate weighs anywhere from approximately two (2) to five (5) ounces, depending on whether it is a slip, partial slip or slip lock latch plate. A weight (mass) of the release components of the buckle (button, slider, locking pin, etc.) is a fraction of the latch plate weight.

The dynamic problem with the end release buckles is that when there is an upward force or upward component of force acting on the buckle or a downward impulse from sudden tensile loading/unloading of seat belt webbing through the latch plate, the latch plate mass applies a downward inertia force or impulse that drives an unlatch mechanism downward toward an unlatch position, accelerating the unlatch mechanism masses downward and thus causing the latch to release. Any horizontal or lateral force acting on the buckle frame in an opposite direction of the unlatch direction compounds the unlatching due to acceleration forces acting on the buckle frame.

The above modes of failure are inherent in virtually all conventional side and end release latching mechanisms of conventional vehicle restraint systems. The side release buckle systems are generally simpler and have fewer moving parts and thus are more economical to construct and to install, whereas the end release systems are more complex having multiple moving parts and are thus more expensive to manufacture.

In view of the foregoing, there remains a need to further improve upon the reliability and effectiveness of vehicle body restraint safety belt systems to ensure that the latching mechanisms associated therewith cannot be accidently released during substantially any type of vehicular movement including vehicle rollovers caused during accidents, collisions or resulting from loss of control of a vehicle, such as by operator error or vehicle equipment failure. There is a further need to provide for improvements in vehicle body restraint systems which permit the latching assemblies to be more reliable and more economic to construct.

SUMMARY OF THE INVENTION

The present invention is directed to vehicle body restraint systems which include buckles for latching and restraining latch plates carried by seat or lap belts and safety harnesses. Preferred embodiments of the invention are disclosed. The embodiments are designed to prevent inertial release of safety restraint buckle or latching assemblies associated with vehicles by requiring intentional manual release of two equally resisted and oppositely oriented push button release mechanisms associated with the buckles such that release of latch plates from the buckles is only possible by the simultaneous manual movement of the oppositely oriented release mechanisms or buttons.

Each locking mechanism utilizes equal and opposite locking forces against opposing lock release buttons such that if a force, or component of force, acts on a body of a buckle which is inline with an actuation direction of one of the release buttons, an equal and opposite force acts against the opposing release button thereby locking it into tighter engagement with the latch of the buckle assembly. Thus, the locking mechanism can not release by the application inertial forces to the buckle assembly. The release of the latch plate can only occur upon the deliberate and simultaneous manual application of force to the two opposing release buttons in opposite directions.

The safety belt assembly of each of the restraint systems of the invention is provided with a latch plate which is insertable so as to be locked and retained within a buckle housing having internal latching components for engaging and preventing the removal of the latch plate until manually released. The buckle housings including an opening in which a latch plate is slidably received. Mounted interiorly of each buckle housing is at least one movable latch which is operable in a first position to engage within an opening in the latch plate to thereby prevent withdrawal of the latch plate until the at least one latch is moved from the opening in the latch plate.

In a first embodiment of the invention, a single latch is movably mounted within the buckle housing against a resilient element or spring which normally urges the latch to its first or "locking" position. The latch includes a latch dog which is engageable with an edge defining the opening in the latch plate to thereby prevent withdrawal of the latch plate once it has been inserted within the buckle housing. The latch is operably connected to a pair of oppositely oriented release buttons which are mounted through opposite sides of the buckle housing. Each of the push or release buttons is engaged with a separate arm of the latch such that both arms of the latch must be engaged simultaneously by the oppositely oriented release buttons to urge the latch to a second or "release" position wherein the latch dog is free of the opening in the latch plate thus permitting the release of the latch plate from the buckle housing.

As noted, a spring is mounted within the buckle housing so as to apply a constant force to the latch in the first locking direction such that, upon insertion of the latch plate within the buckle housing, the latch locking dog is urged into engagement with the latch plate as soon as the opening of the latch plate passes the latch dog of the latch.

The buckle housing includes an internal frame component on which the opposing push buttons are guidingly engaged. The housing is also configured such that the push buttons are recessed relative thereto to thereby prevent accidental engagement with, and inadvertent actuation of, the buttons. A resilient element, such as a spring, is mounted between each of the push buttons so as to apply an equal and opposite force urging each of the buttons to a first and outer locking position. With this arrangement, when a force is applied to move, one of the push buttons to a second release position wherein the push button is pushed inwardly of the housing, an opposite force is directed to the opposing push button thereby providing additional force to maintain the opposite push button in its first or locking position. Therefore, unless both push buttons are moved to their inner release positions simultaneously, the latch can not be moved to its second release position as one of the push buttons will be engaging an arm of the latch to prevent its movement from its first locked position. Further, the greater the force applied to one push button to move it to its release position, the greater the force applied to the opposite release button to retain it in its locked position.

In the first embodiment, the latch plate is specially constructed so as to simultaneously urge each of the push buttons to their second release positions upon the insertion of the latch plate into the buckle housing. In this respect, the latch plate includes a pair of forwardly spaced tangs having beveled edges which are engageable in slots in each of the push buttons so as to cam each push button to its second release position upon the insertion of the tangs until the opening in the latch plate is aligned to allow the latch dog of the latch to be resiliently urged within the opening to thereby lock the latch plate within the buckle housing.

In a second embodiment of the invention, a pair of latches are mounted within the buckle housing on opposite sides of a channel in which the latch plate is slidingly received when inserted through the opening in one end of the buckle housing. Each of the latches is resiliently urged to a first locking position in which lock dogs associated with each latch are engageable within the opening in the latch plate with the oppositely oriented latch dogs being positioned generally side-by-side when the latches are in the first locked position. Further, two push buttons are mounted through opposite sidewalls of the housing as with the first embodiment. Each push or release button includes an extended catch member which is generally u-shaped and designed to engage a separate one of the latch plates so as to prevent movement of the latch plate from the first locking position to a second release position wherein the latch dogs associated with the latches are moved from the opening in the latch plate to thereby permit the withdrawal of the latch plate.

Each push button further includes a beveled surface for engaging an opposing side of the latch associated therewith which side is also beveled, such that, upon movement of the push buttons from their first outer locking position inwardly to their second release position, the beveled surfaces will urge the adjacent latch to be moved to its second release position.

In order to ensure that both push buttons must be moved to their second release positions simultaneously to release the latch plate from the buckle housing, a pair of springs are provided between each of the catch portions of the push buttons and the opposing push button. If force is applied to move either push button to its second release position, an opposite force is directed by the interconnecting spring or resilient element to urge the opposing push button outwardly with increased force so as to maintain the opposite push button in its first locked position. Therefore, only by the simultaneous application of force to each of the opposing push buttons to move them inwardly relative to the buckle housing can both latches be moved to their second release positions to permit the latch plate to be withdrawn from the buckle housing.

It is the primary object of the present invention to provide safety restraint assemblies for vehicles which include buckle and latch plate mechanisms which can not be released by inertial forces applied to the components of the assemblies such as caused by vehicle accidents including rollovers.

It is a further object of the present invention to provide latching and locking mechanisms for seat belt restraint systems which follow Newtonian Laws of Physics to the effect that for every action, there is an equal and opposite reaction, so that a latch plate can not be released relative to a buckle unless oppositely directed forces are applied to a pair of opposing push buttons associated with the restraint systems.

It is also an object of the present invention to provide latching and locking mechanisms for seat belt restraint systems wherein the inadvertent or accidental application of force to one of a pair of release push buttons associated therewith can not cause the release of latch plates of the restraint systems and further wherein such accidentally application of force supplies a greater force to retain the other of the release buttons in a locked position.

It is yet a further object of the present invention to provide non-inertial release restraint buckles for use in seat belt restraining systems of the type utilized in automotive vehicles and the like wherein the buckle latching assemblies can be structured from a minimal number of operative components to thereby reduce a risk of component failure while decreasing manufacturing costs of the restraint buckles.

BRIEF DESCRIPTION OF THE DRAWINGS

A better understanding of the invention will be had with respect to the embodiments disclosed and with reference to the attached drawings wherein:

FIG. 1 is a perspective illustrational view of a first embodiment of the present invention shown with the buckle housing removed and wherein the latch plate is connected to a conventional seat belt with the buckle being connected to a conventional anchor belt;

FIG. 2 is a view similar to FIG. 1 showing the latch plate of the first embodiment detached from the buckle housing;

FIG. 24 is a cross-sectional illustrational view taken along line 22—22 of FIG. 16 showing the simultaneous movement of the release push buttons from a first lock position to a second release position;

FIG. 25 is an illustrational view taken along line 21—21 of FIG. 16 showing the latch plate released from the buckle housing;

FIG. 26 is a view taken along line 22—22 of FIG. 16 showing how the push buttons cannot be accidentally engaged to a release position because they are recessed within the side walls of the buckle housing; and FIG. 27 is a cross-sectional view taken along line 27—27 of FIG. 26 but showing push button 225 being pushed in to release one latch thereby causing the opposite latch to be forced into tighter engagement with the latch plate to prevent its release.

DESCRIPTION OF THE PREFERRED EMBODIMENTS

Figure 3:
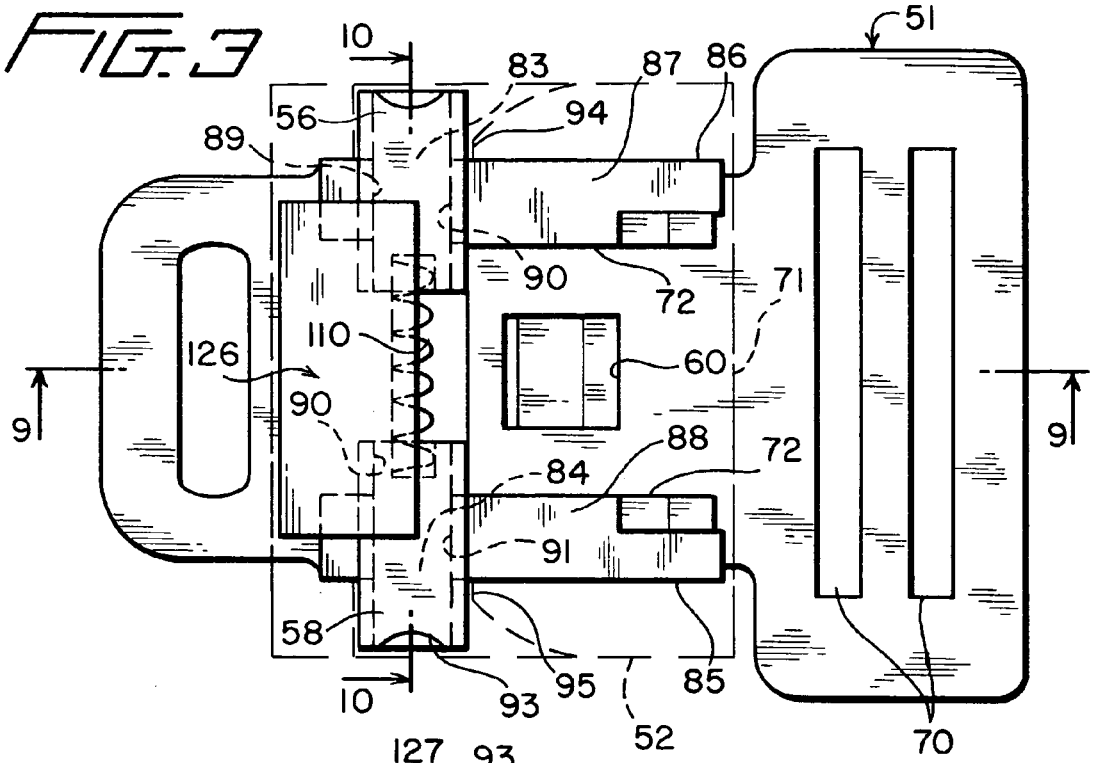
FIG. 3 is a top plan view showing the latch plate of the embodiment of FIG. 1 connected to the frame of the buckle and with the housing removed.

With continued reference to FIGS. 1–13 of the drawing figures, a first embodiment of non-inertial release restraint buckle of the present invention will be described as used with a seat belt restraint system of a vehicle. Such a restraint system includes a seat belt 50 in the form of a harness or lap belt which is mounted to a latch plate 51 for insertion into a buckle 48. The buckle includes a housing 52 which is connected by way of a buckle housing frame member 53 to an anchor belt 54 which is normally connected to an anchor bracket which is bolted to a frame of the vehicle.

The buckle housing 52 has been removed to show the inner workings of the buckle and latch plate in FIGS. 1 and 3–13, however, the housing is shown in FIG. 2 with respect to the first embodiment and is also shown in all figures with respect to a second embodiment in FIGS. 14–27. As is illustrated in FIG. 2, to release the latch plate 51 from the buckle 48, simultaneous forces must be applied to the opposing release push buttons 56 and 58 associated therewith.

In the first embodiment showing in FIGS. 1–13 the latch plate 51 includes an opening 60 for purposes of receiving a locking or latching mechanism as will be described in greater detail hereinafter. Forwardly of the opening 60 are a pair of spaced tangs 61 and 62 each having beveled inner surfaces 63 and 64, respectively, see FIG. 7, which taper inwardly from a front of the latch plate to an enlarged opening 67 between the tangs. The tangs form opposing locking catch hooks 65 and 66 which function to provide a secondary locking function when the latch plate is fully inserted within the buckle housing, as will be described. It should be noted that the opening 60 is spaced rearwardly of an inner edge 68 of the opening 67. The latch plate 51 further includes a base portion 69 which is somewhat enlarged compared to the leading tang portion and which includes slots 70 for receiving the seat, lap or harness belt 50.

The buckle housing 52 has an opening 71 in one end thereof for receiving the latch plate. The opening communicates with opposing channels or passages 72 formed by the buckle frame member 53 in which the latch plate is slidingly received when inserted into the buckle housing.

Figure 7:
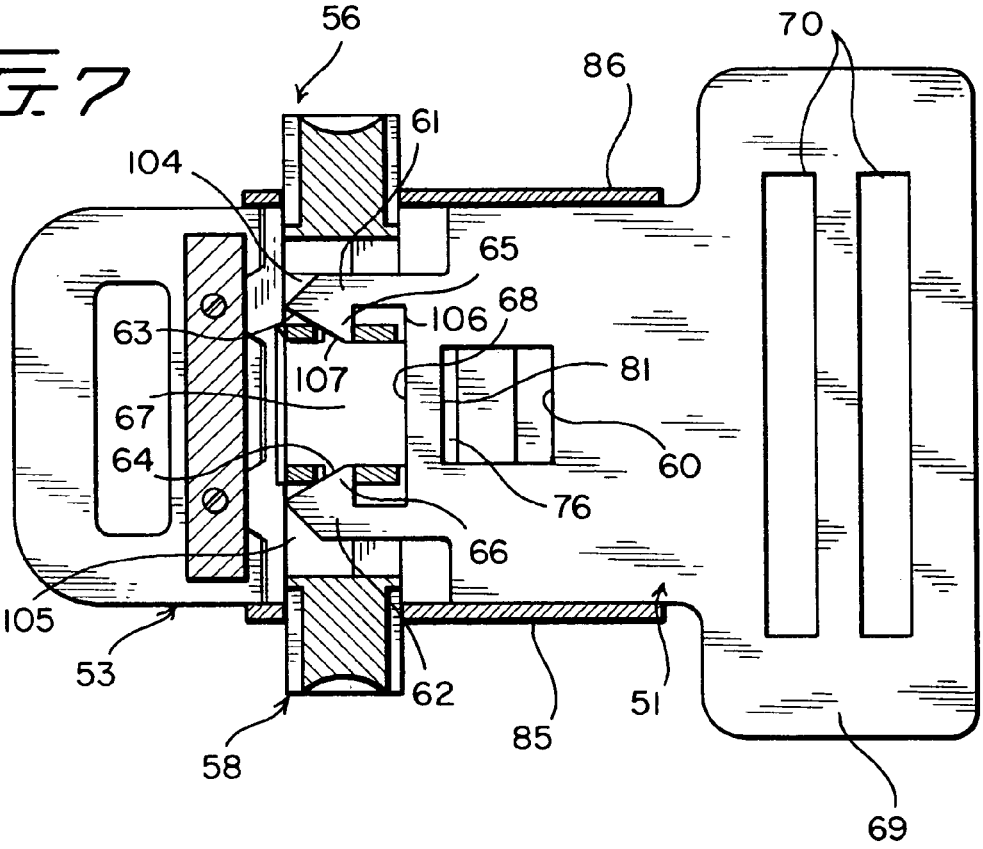
FIG. 7 is a cross-sectional view taken along line 7—7 of FIG. 4.
Figure 8:
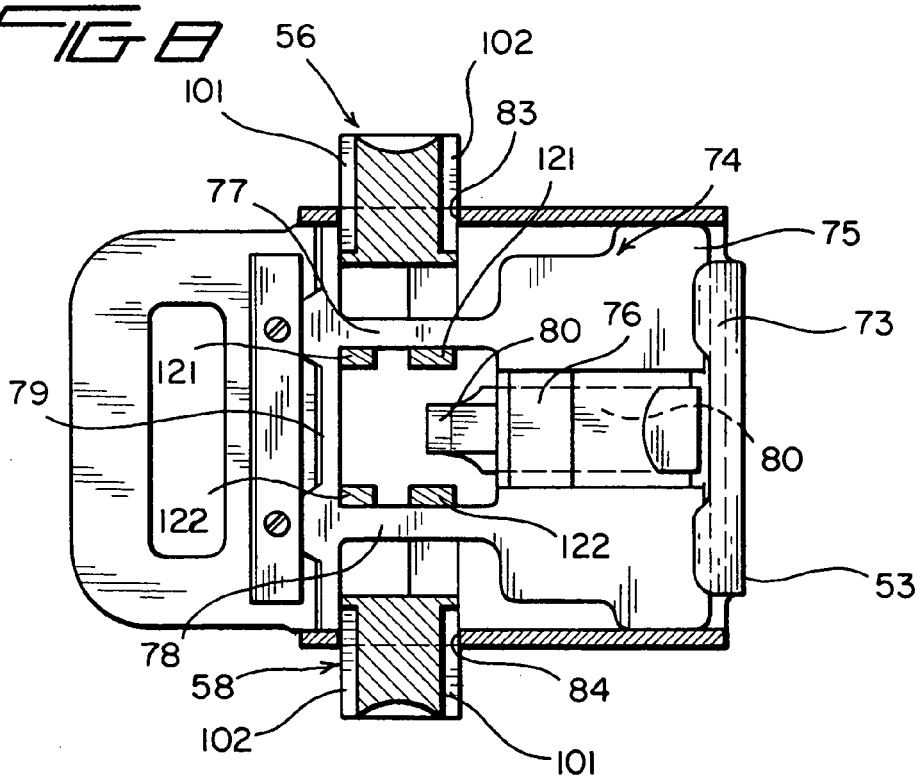
FIG. 8 is a cross-sectional view taken along line 8—8 of FIG. 4.

Mounted within the housing 52 is a single latch 74 which is movably mounted at its base 75 within a lip 73 of the buckle frame, see FIG. 8. A lock or latch dog 76 is provided generally centrally of the latch, and extends outwardly from a plane of the base of the latch. The latch is movable from a first locking position, wherein in the latch dog is positioned so as to engage within the opening 60 of the latch plate, see FIGS. 1, 2, 7 and 9, to a second release position wherein the latch and latch dog 76 is pivoted away from the channels 72 to permit the insertion and withdrawal of the latch plate 51, see FIG. 12. Extending forwardly of the latch dog 76 are a pair of latch control arms 77 and 78 which are spaced on either side of the latch dog. The control arms are connected by a forward connector element 79 such that the arms 77 and 78 are rigidly secured relative to one another.

Figure 9:
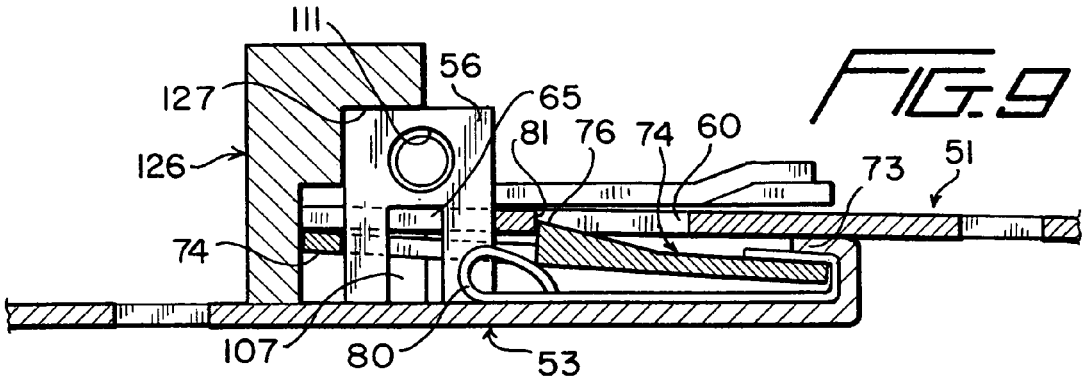
FIG. 9 is a cross-sectional view taken along line 9—9 of FIG. 3.

The latch 74 is continuously urged to its first locking position by a leaf spring or other resilient element 80, as is shown in FIG. 9. When the latch plate 51 is inserted within the channels 72 of the buckle housing 52, the latch plate will engage the lock dog 76 and cam the latch 74 to its second release position. Once the opening 60 passes the leading edge of the lock dog 76, the spring 80 will urge the latch dog into the opening 60 to thereby prevent withdrawal of the latch plate 51 with the latch dog 76 engaging an edge 81 at the forward portion of the opening 60. This action provides a first and primary locking function for retaining the latch plate within the buckle.

Also provided within the housing 52 is a portion of the buckle frame 53. The frame generally includes a base portion 82 which is fixedly secured to a lower wall of the housing 52. The frame includes a pair of side openings 83 and 84 formed in opposite sidewalls 85 and 86 thereof. The sidewalls 85 and 86 have inwardly extending flanges 87 and 88 associated therewith which extend inwardly of the housing and thereby define the channels 72 for guiding the latch plate within the buckle.

To control the release of the latch 74, the present embodiment of the invention utilizes the pair of oppositely oriented and opposing release push buttons 56 and 58. The push buttons are slidably mounted on opposing tracks 89, 90 and 91, 92 defined in the flanges 87 and 88, respectively, of the sidewalls of the frame so as to movable within the openings 83 and 84 in the sidewalls 85 and 86 of the buckle frame.

Each of the push buttons 56 and 58 are generally similarly configured but are mirror images of one another. The push buttons include concave finger engaging outer surfaces 93 which extend generally flush with or slightly within recessed sidewall openings 94 and 95 of the housing 52. The housing 52 and openings 94 and 95 are illustrated in dotted line in FIG. 3. The recessed sidewalls of the buckle housing are better shown in FIGS. 14, 16 and 17 with respect to a second embodiment of the invention. The push buttons further include a pair of spaced closed slots 101 and 102 which are of a size to be slidingly received on the spaced guide tracks 89, 90 and 91, 92.

With reference to FIG. 7, each push button also includes an open slot 104, 105 which extends along a full length of the push button in which one of the tangs of the latch plate is slidingly received when the latch plate is inserted within the buckle housing. The push button 56 includes the slot or channel 104 for receiving the tang 61 of the latch plate. Push button 58 includes slot 106 for receiving tang 62. As previously described, each tang includes an inner beveled surface. Latch plate tang 61 includes a beveled surface 63 which engages against a side edge 106 defining one side of an opening into the slot 104 of the push button 56. In this manner, when the latch plate is inserted within the buckle housing 52, the latch plate tang 61 will engage within the slot 104 with the cam surface 63 thereof urging the push button inwardly of the housing by engagement with the wall or edge 106, thus moving the push button 56 into the buckle housing. When the tang member is fully seated, the hook 65 of the tang 61 engages within an opening 107 in an inner end wall of the push button 56 and thereby provide a secondary locking function to retain the latch plate in the buckle housing. In a like manner, the beveled portion 64 of the tang 62 engages a wall 108 of push button 58 as the latch plate is inserted within the buckle housing. Contact of the latch plate with push button 58 urges the button inwardly of the housing until the hooked end 66 of tang 62 seats in an opening 109 in an inner wall of push button 58 to thereby further lock the latch plate within the housing.

The seating of the latch plate tangs in the openings in the push buttons occurs simultaneously with the seating of the latch dog 76 within the opening 60 in the latch plate 51. Thus, there are three separate points of engagement of the latch plate with the components of the buckle. Further, proper alignment of the latch plate is assured by the edge 68 of the latch plate engaging the front face of the push buttons when in the locked position as shown in FIG. 7.

Figure 10:
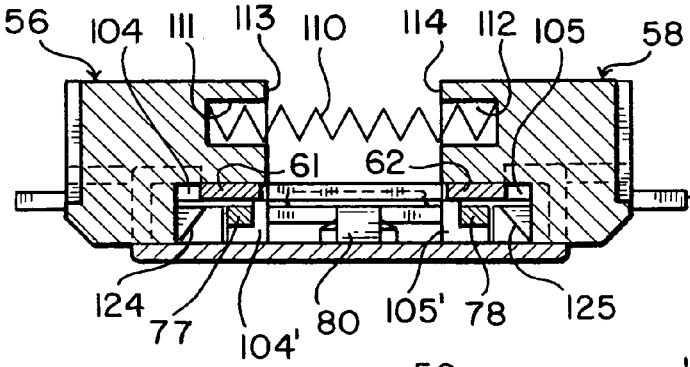
FIG. 10 is a cross-sectional view taken along line 10—10 of FIG. 3 showing the release push bottons in a first outer locking position.

The movement of the push buttons 56 and 58 to their first or outer locking position, as shown in FIGS. 7 and 10, is accomplished by a spring or similar resilient element 110 which is mounted within recessed seats 111 and 112 formed in the inner walls 113 and 114 of the opposing push buttons. The spring ensures that an equal and opposite force is applied to urge each of the push buttons to their first, outer locking position. The connection of the spring 110 further ensures that if a force is applied to one of the push buttons alone, to move the one push button from its first outer locking position to an inner release position, an increased force is applied by the compression of the spring 110 to urge the opposite push button more tightly into its first locking position. It is this equal and opposite application of force, based upon Newtonian Laws of Physics, which makes the lock mechanism of the present invention failsafe and not subject to premature release by inertial forces which can be caused during vehicle accidents. More specifically, any force applied to one push button to release it, without an opposite force being applied to the opposing push button, can not result in the unlatching of the latch 74 or a release of the latch plate tangs from both release push buttons.

To control the release of the latch 74, each push button has an opening 104', 105' along the full width thereof which communicate with the slots 104, 105, respectively, in which the arms 77 and 78 of the latch are received. As shown in FIG. 10, when the latch is in its locked position, each arm 77 and 78 is seated on pairs of outwardly extending catches or shoulders 121 and 122 of the push buttons 56 and 58 and thus, the latch can not be moved downwardly to its second unlocked or release position. However, each push button includes a beveled wall 124, 125 opposing the catches 121 and 122 such that when the push buttons are urged inwardly of the buckle housing, toward their release position, see FIG. 11, the arms of the latch are free of the catches so as to be engageable by the beveled surfaces 124, 125 which thereby urge the latch arms to move the latch to its second release position against the influence of the spring 80. In the second position of the latch, the latch plate may be easily withdrawn from the buckle housing as the tangs and latch dog are simultaneously release from the push buttons and latch plate, respectively.

Although not specifically shown in the drawing figures, it is possible that a separate spring element may be utilized in association with the latch plate frame of the present invention in order to provide a discharge force for further facilitating the removal of the latch plate from the buckle housing. Examples of such ejection mechanisms are described in applicant's prior U.S. Pat. No. 6,539,595 issued Apr. 1, 2003, the entire contents of which are incorporated herein by reference.

Figure 11:
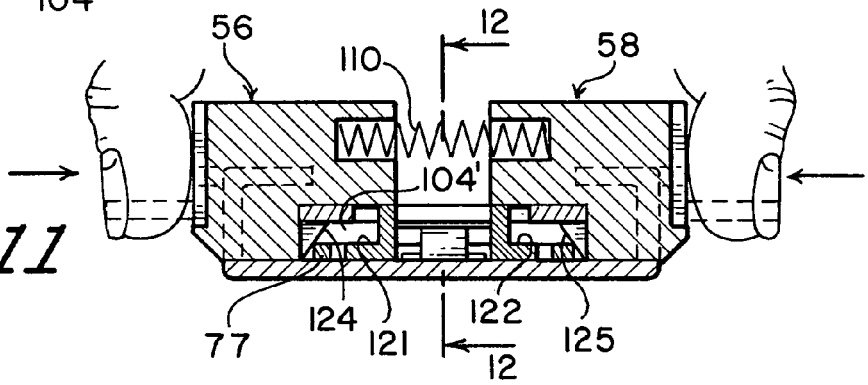
FIG. 11 is a view taken along line 10—10 of FIG. 3 illustrating the release push buttons being simultaneously engaged to permit release of the latch plate from the buckle frame.
Figure 12:
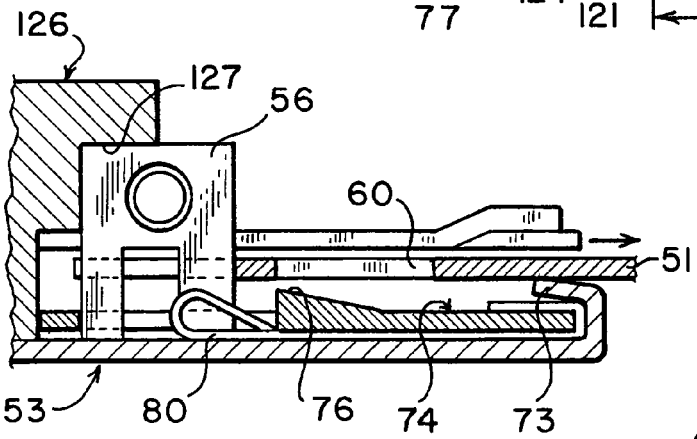
FIG. 12 is a cross-sectional view taken along line 12—12 of FIG. 11.
Figure 13:
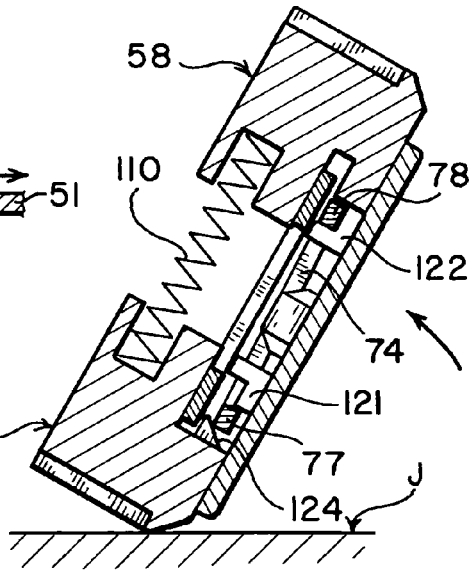
FIG. 13 is a cross-sectional view taken along line 10—10 of FIG. 3 illustrating the movement of one push button toward a release position while the other push button is urged to a tighter locked position.
Figure 14:
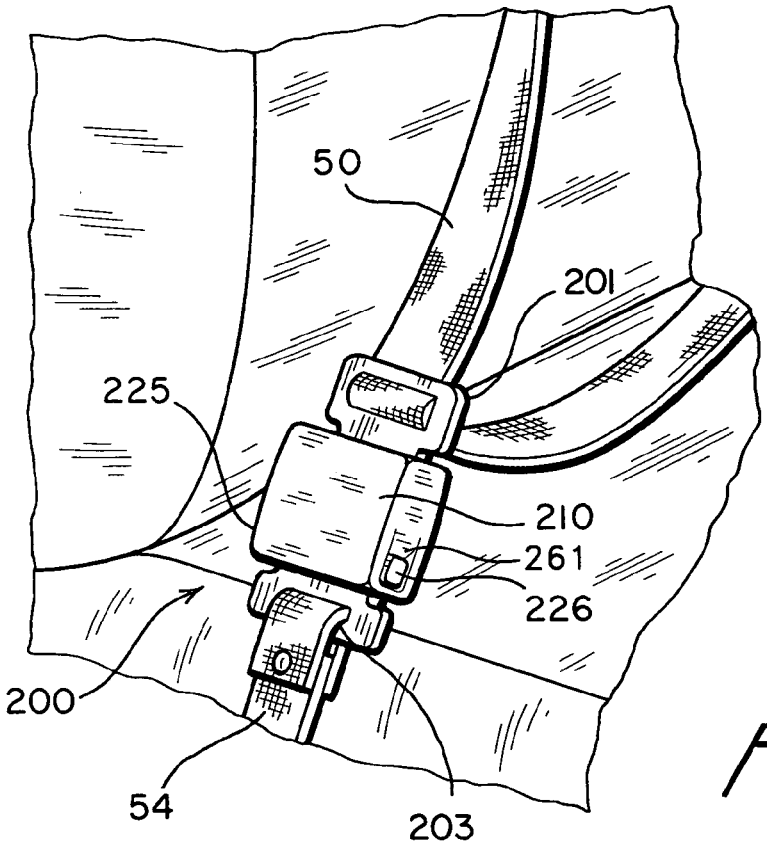
FIG. 14 is a perspective illustrational view of a second embodiment of the present invention connected to a seat belt and anchor belt of a conventional vehicle wherein the buckle housing is shown surrounding the buckle frame and having opposite recesses in which the opposing push bottons are seated.
Figure 15:
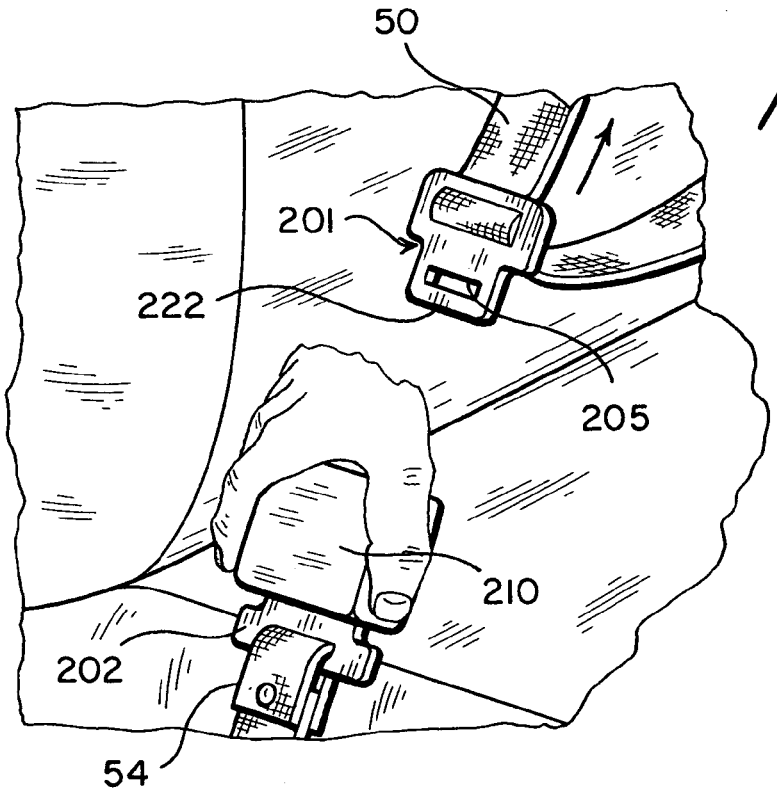
FIG. 15 is an illustrational view similar to FIG. 14 except showing the latch plate of the second embodiment released from the buckle housing.
Figure 16:
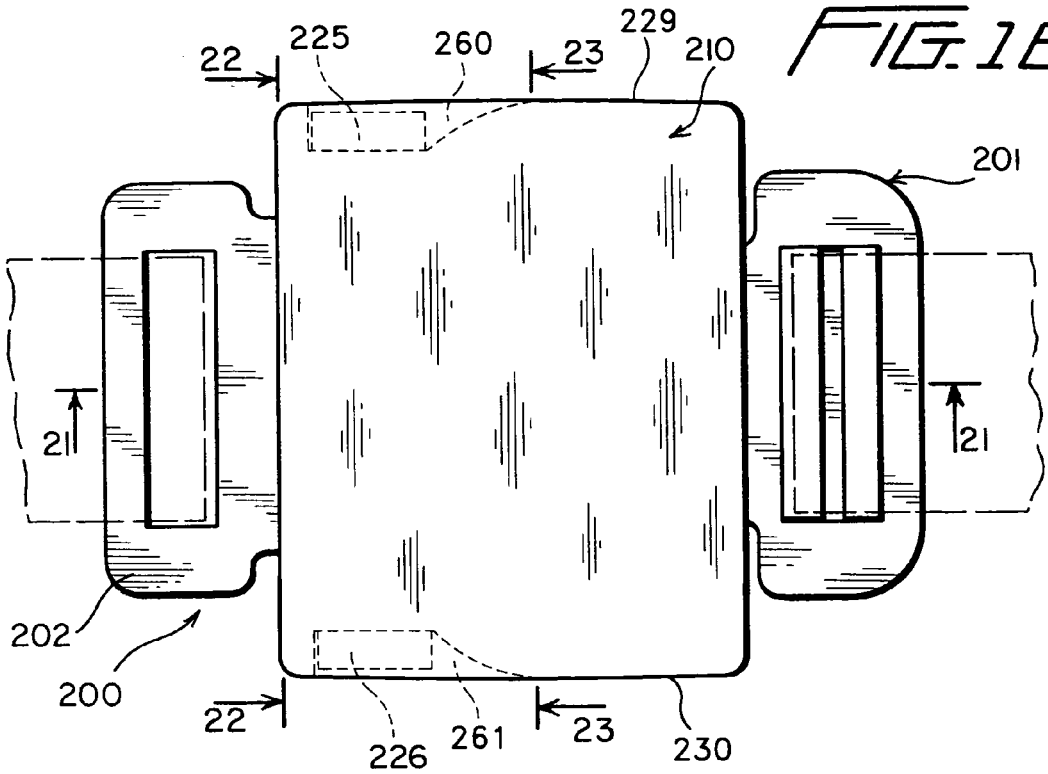
FIG. 16 is a top plan view of the second embodiment of the invention showing in dotted lines the recessed side walls of the buckle housing in which the push buttons are protectively seated.
Figure 17:
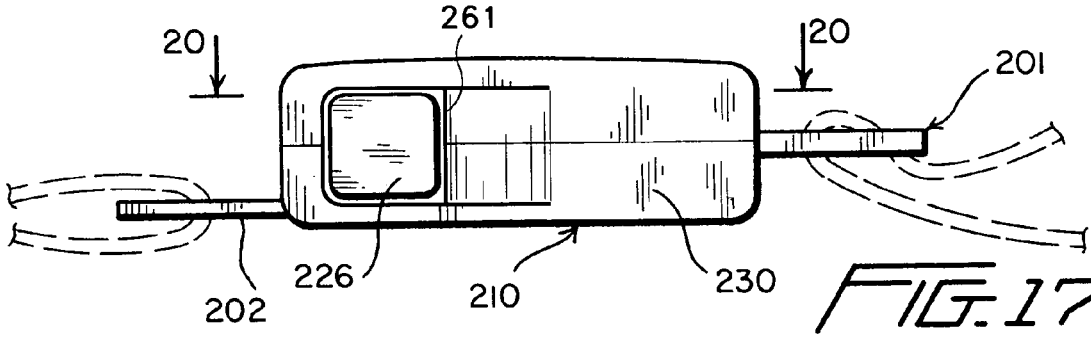
FIG. 17 is a right side view of the embodiment shown in FIG. 14.
Figure 18:
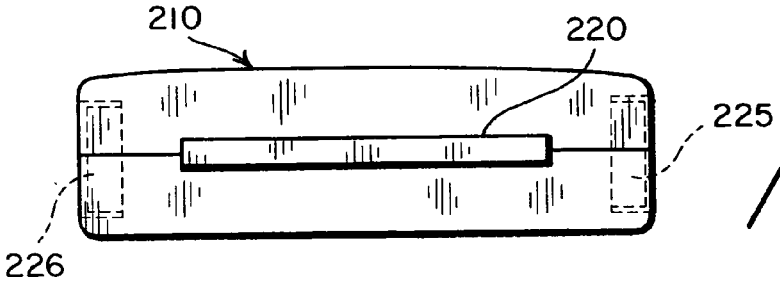
FIG. 18 is a front elevational view of the embodiment shown in FIG. 14.
Figure 19:
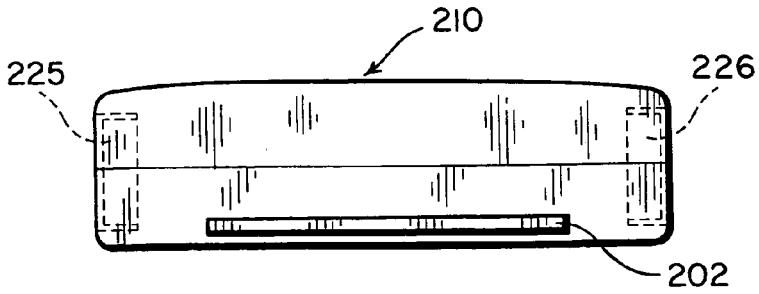
FIG. 19 is a rear elevational view of the embodiment shown in FIG. 14.
Figure 20:
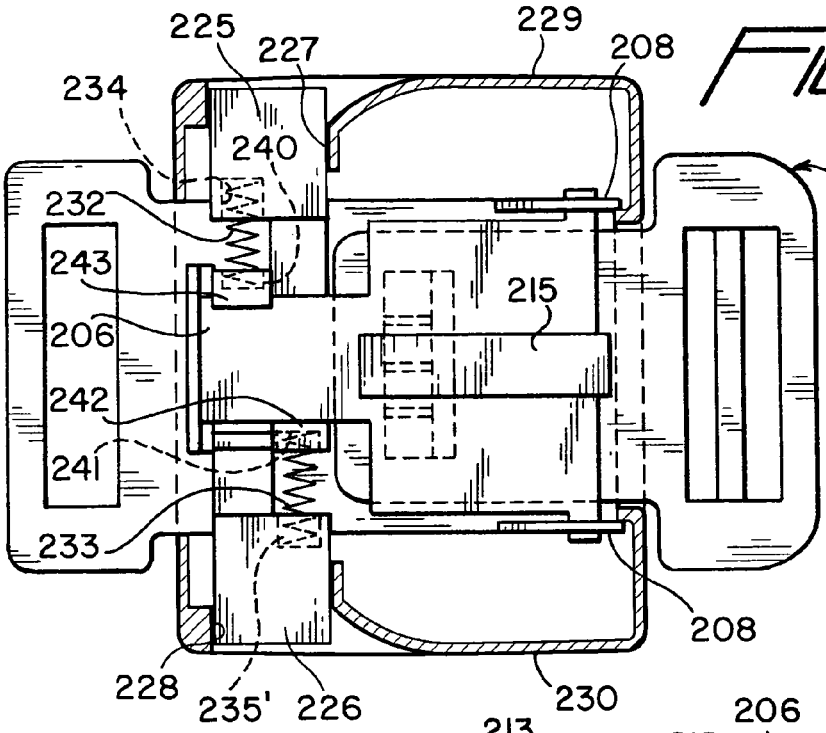
FIG. 20 is a cross-sectional view taken along line 20—20 of FIG. 17.

From the foregoing description, it should be noted that each push button 56 and 58 supports a separate one of the arms 77 and 78 of the latch. Therefore, both push buttons must be moved to their release positions to release each of the arms 77 and 78 in order that the latch can be moved to its second or release position by a force of engagement of the beveled walls or surfaces 124, 125 associated with the push buttons. The premature movement of either push button alone, as shown in FIG. 13, will only cause the catches 121, 122 of the associated push button to release, one of the latch arms but will not release the opposing arm of the latch which is retained locked by the catches of the opposing push button. In FIG. 13, push button 56 is engaged with an object "J" which applies a force to urge the push button to its release position wherein latch arm 77 is released from catches 121. However, the spring 110 applies an increased force against push button 58 to maintain latch arm 78 locked within the catch 122. Therefore, both push buttons must be moved inwardly of the buckle housing, simultaneously, as shown in FIG. 11 in order to cause a release of the latch plate.

Figure 4:
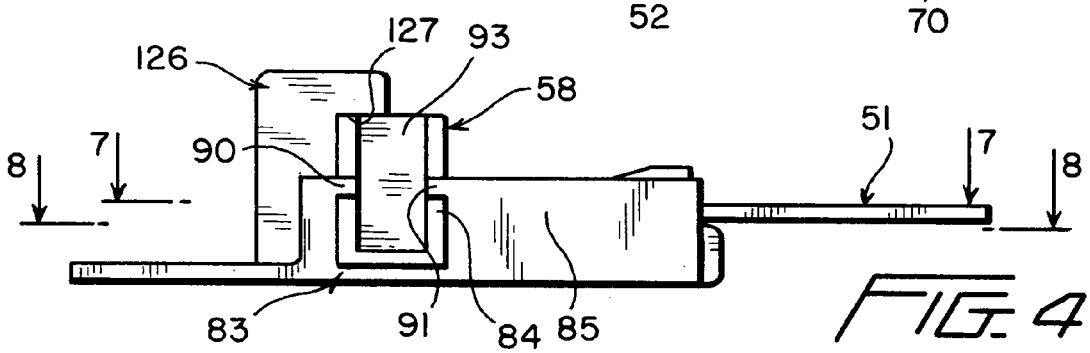
FIG. 4 is a view taken from the right side of the latch plate and buckle frame of FIG. 3.
Figure 5:
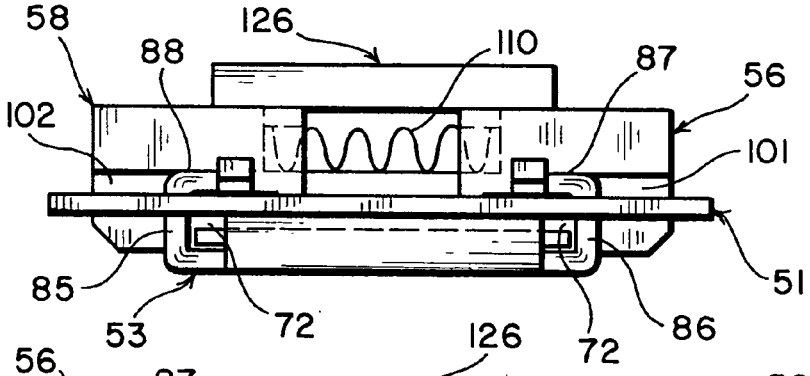
FIG. 5 is a front plan view of the latch plate and buckle frame of FIG. 3.
Figure 6:
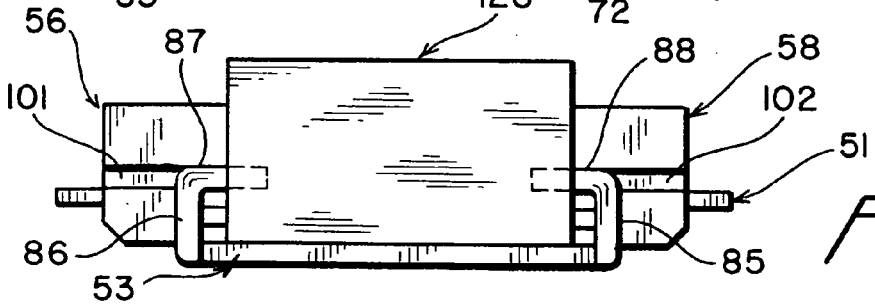
FIG. 6 is a rear elevational view of the buckle frame and latch plate shown in FIG. 3.

To further guide the push buttons 56 and 58 of the present embodiment in their sliding movement between their outer locked position and their inner release positions, a guide block 126 is secured to the buckle frame 53. The block includes a depending flange 127 which extends over a top portion of each push button as shown in FIGS. 3, 4 and 9.

With particular reference to FIGS. 14–27, a second embodiment of the invention is disclosed in greater detail. In this embodiment, the non-inertia release restraint buckle assembly 200 is shown as including a latch plate 201 which is connected to a conventional seat belt, lap belt or restraint harness 50 in a manner similar to that disclosed with respect to the first embodiment. Likewise, the buckle assembly includes an outer frame member 202 having an opening 203 therein for receiving an anchoring strap 54 which is connected to a bracket or otherwise secured to the frame of a vehicle.

Figure 21:
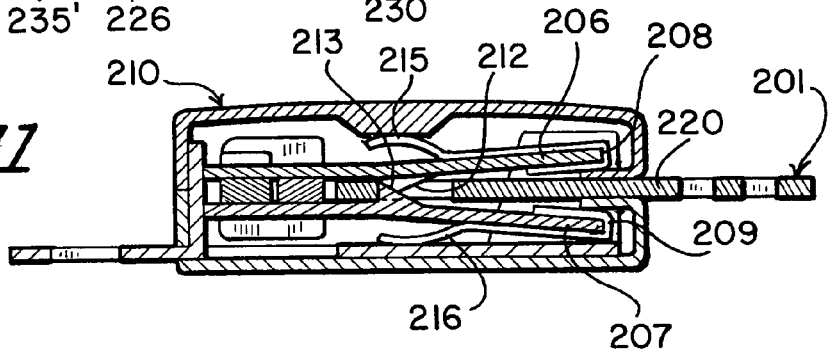
FIG. 21 is a cross-sectional view taken along line 21—21 of FIG. 16.

In this embodiment, the latch plate 201 includes an opening 205 for cooperating with a pair of latches 206 and 207 which are movably mounted at 208 and 209 within a buckle housing 210. Each of the latches 206 and 207 includes at least one and preferably two spaced outwardly extending latch dogs 212 and 213, respectively. As shown in the drawing figures, the pairs of latch dogs are structured to fit in an interdigitated manner within the opening 205 in the latch plate when the latch plate is fully seated within the housing 210. In this manner, both latches 206 and 207 must be moved from their first locking position, as shown in FIG. 21, to a second release position, as shown in FIG. 25, in order to permit the insertion or removal of the latch plate 201 from the buckle housing 210. To ensure that each of the latches 206 and 207 is normally urged to its first locked position, each is resiliently urged by a leaf or other resilient or spring element 215 and 216, respectively, toward the locked position.

As with the previous embodiment, the housing has an opening 220 at one end thereof which communicates with a channel 221 defined between the latches 206 and 207 in which the latch plate 201 is slidingly receivable when inserted within the housing 210. As the latch plate 201 is inserted within the housing, the leading edge 222 thereof will engage cam like surfaces on the back of each latch dog thus pushing the latches 206 and 207 outwardly away from the channel 221 and permitting the latch plate to be fully inserted until such time as the latch dogs snap into engagement within the opening 205 in the latch plate to thereby lock the latch plate in position within the housing 210.

The present embodiment of the invention operates under the same laws of Newtonian Physics as the first embodiment in that, in order to release the latch plate 201 from the buckle housing 210, force must be applied to two opposing release or push buttons 225 and 226 which are mounted to extend outwardly through two spaced recessed openings 227 and 228 in opposite sidewalls 229 and 230 of the buckle housing 210.

As opposed to using a single resilient or spring element between the push buttons as disclosed with respect to the previous embodiment, in the present embodiment, a pair of spaced springs 232 and 233 are mounted within the housing so as to be supported within seats 234 and 235 of the push buttons 225 and 226, respectively. The opposite ends of the springs 232 and 233 are seated within seats 240 and 241 which are provided within generally u-shaped catches 242 and 243 of each of the opposite push buttons 225 and 226, respectively.

Figure 22:
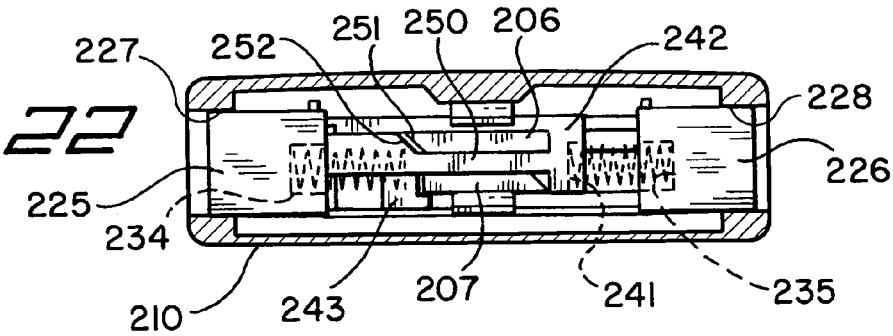
FIG. 22 is a cross-sectional view taken along line 22—22 of FIG. 16.
Figure 23:
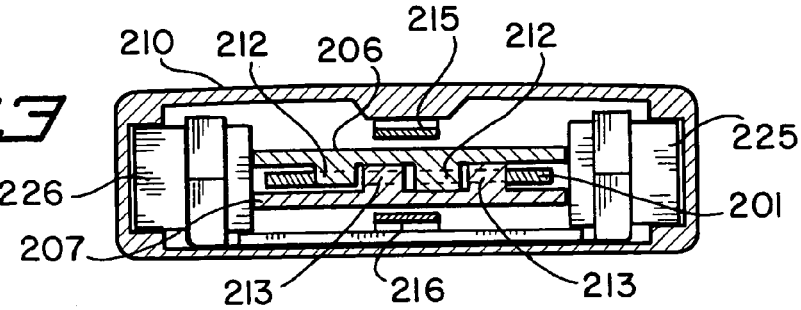
FIG. 23 is a cross-sectional view taken along line 23—23 of FIG. 16.

With specific reference to FIG. 22, push button 225 has an extension portion 250 which integrally connects the push button to its inner u-shaped catch 242. The unshaped catch engages a spaced or remote edge of the latch 206 to thereby retain the latch in its first or locked position. The latch 206 further includes a beveled or cam surface 251 which opposes a camming surface 252 of the push button 225 such that, when the push button 225 is pushed inwardly towards its second release position, the catch 243 will release one edge of the latch 206 and the camming surface 252 of the push button will move the latch, by engagement with its surface 251, to its second release position. However, even if the latch 206 is moved to its release position, the latch 207 remains engaged with the latch plate unless the push button 226 is pushed inwardly to its second release position.

Push button 226 also includes an extension portion 255 as shown in FIG. 26 which extends to its inner catch 243. The push button also includes a beveled or camming surface 256 which is engageable with a beveled surface 257 associated with the latch 207, see FIG. 24. In this manner, when the push button 226 is pushed inwardly of the housing 210, the catch 243 will release the latch 207 allowing the two cam surfaces to urge the latch 207 to its outer or second release position.

As each of the push buttons 225 and 226 are depressed inwardly of the housing, the springs 232 and 233 associated therewith will apply an increased force against the opposing push button. Therefore, any force applied to one of the push buttons to push it inwardly of the housing to its second release position will result in an increased force being applied to maintain the opposing push button in its first or outermost locked position. Thus, to release the latch plate, opposite forces must be applied to the opposing push buttons, as shown in FIG. 24, in order to effect a release of the latch plate 201 from the buckle housing. As soon as the latch plate has been removed from the buckle housing and the push buttons released, the springs 233 and 232 will urge the push buttons to their outer or first locked position and the springs 215 and 216 will automatically cause the latches 206 and 207 to move to their first locking positions.

In the operation of the second embodiment, upon insertion of the latch plate 201, the latches 206 and 207 will be cammed away from one another by the leading edge 222 of the latch plate engaging the cam surfaces of the lock or latch dogs 212 and 213 until such time as the latch dogs snap into the opening 205 to lock the latch plate within the housing. Thereafter, should any inadvertent force be applied to the buckle, its housing or elements causing an inadvertent depression of one of the push buttons, such inadvertent depression, which may be caused by movement of the belt buckle during an accident, will not effect a release of the latch plate. In FIG. 27, push button 225 is shown as being accidentally moved to its release position thereby releasing latch 206 from the catch 242. However, when moved to this position, the spring 232, see FIG. 20, will apply an increased force on the opposing push button 226 thereby ensuring that the opposing push button is maintained in its locked or outer position preventing release of the catch 243 from latch 207.

Only upon application of simultaneous forces to the opposing latch buttons 225 and 226 in opposing directions, as shown in FIG. 24, can the latch plate 201 be released from its locked engagement with the latches 206 and 207.

With particular reference to FIGS. 14, 16 17 and 26, the buckle housing 210 is specifically designed and configured to prevent accidental contact with the push buttons 225 and 226 which could lead to an inadvertent actuation of the buttons to move them toward their release positions. Each sidewall 229 and 230 is recessed inwardly as shown in dotted line in FIG. 16 at 260 and 261, respectively, such that the openings 227 and 228 for the push buttons are recessed inwardly of the outer portions of the sidewalls. As shown, the outer engageable portions of each push button are thus slightly recessed relative to the outer portions of the sidewalls when in their outermost, first locking position, thereby preventing their accidental depression, as is illustrated in FIG. 26. As shown in FIG. 26, should a sidewall of the buckle housing engage a surface of object "J", the release buttons will not be depressed due to their inset position or mounting relative to the outer portions of the sidewalls. the same recessed features are provided for the buckle housing and push buttons of the embodiment of FIGS. 1–13.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A non-inertial release restraint buckle assembly for use in vehicles having restraining belts, the buckle assembly comprising: a buckle housing, a latch plate receiving channel defined within said housing, an opening in one end of said housing communicating with said channel and of a size to receiving a latch plate therein, a latch plate having a leading end, an opening in said latch plate spaced from said leading end, at least one latch mounted in said housing and including latch means for engaging within said opening in said latch plate when said at least one latch is in a first locked position to prevent withdrawal of said latch plate from said housing, said at least one latch being resiliently moveable against a first resilient means that normally urges the at least one latch toward said first locked position thereof to a second release position spaced from of said opening to permit said latch plate to be inserted into and withdrawn from said housing, a pair of oppositely oriented push button mechanisms mounted within said housing and extending outwardly through openings in opposite side walls of said housing, each of said push button mechanisms being movable generally transversely with respect to an elongated axis of said channel from first outer locking positions relative to said housing wherein a portion of each of said push button mechanisms retains said at least one latch in said locked position thereof to second inner release positions relative to said housing wherein said push button mechanisms no longer retain said at least one latch in said locked position thereof, second resilient means mounted within said housing for constantly urging said push button mechanisms toward said first locking positions thereof with oppositely directed forces and such that when one of said push button mechanisms is urged toward it's second release position by a force, a simultaneous increase in force is applied to retain the other push button mechanism in said first locking position thereof, and each of said push button mechanisms being engageable with said at least one latch so as to move said at least one latch to said release position thereof to permit insertion or withdrawal of said latch plate only when said push button mechanisms are simultaneously urged to said second release positions thereof whereby said at least one latch can not be moved to release a latch plate in engagement therewith by inertial forces applied to said buckle housing.

2. The non-inertial release restraint buckle assembly of claim 1 wherein said openings in said opposite side walls of said housing are in recessed areas of said opposite side walls, and said push button mechanisms including outer engageable portions which do not extend outwardly beyond said side walls of said housing when in their first outer locking positions.

3. The non-inertial release restraint buckle assembly of claim 1, wherein said latch means of said at least one latch is moved out of a plane of the latch plate when said at least one latch is moved to said second release position thereof.

4. The non-inertial release restraint buckle assembly of claim 3 including a buckle frame mounted within said housing, said buckle frame including opposing channels defining said channel for receiving said latch plate within said housing, said frame having opposite sidewalls having openings therein which are aligned with said openings in said opposite sidewalls of said housing for receiving said oppositely oriented push button mechanisms therein, and said frame including means for guiding said oppositely oriented push button mechanisms within said housing.

5. The non-inertial release restraint buckle assembly of claim 3 in which said at least one latch includes a pair of spaced arms extending forward of a body portion, said latch means extending from said body portion of said at least one latch, said portion of each of said push button mechanisms including a catch for selectively engaging one of said spaced arms of said at least one latch to thereby retain said at least one latch in said first locked position thereof when said push button mechanisms are in said first outer locking positions thereof, said catches being movable to a second position to release said spaced arms and said at least one latch to be movable to said second release position thereof by engagement of a cam portion of each of said push button mechanisms with said spaced arms when said push button mechanisms are moved to said second inner release positions thereof.

6. The non-inertial release restraint buckle assembly of claim 5 in which said second resilient means is mounted between said pair of oppositely oriented push button mechanisms so as to apply an equal and opposite force thereto.

7. The non-inertial release restraint buckle assembly of claim 6 wherein said latch plate includes a pair of forward extending and spaced tangs, each of said tangs having a cam surface which is engageable with one of said push button mechanisms when said latch plate is inserted within said channel of said housing to thereby urge said push button mechanisms from said first outer locking position to said second inner release position thereof.

8. The non-inertial release restraint buckle assembly of claim 7, wherein each of said push button mechanisms includes a first opening therein for receiving said tangs when said latch plate is fully inserted within said housing and said latch means of said at least one latch is engageable within the opening in said latch plate whereby said push button mechanism are urged to said first outer locking position thereof by said second resilient means.

9. The non-inertial release restraint buckle assembly of claim 8 including second openings in each of said push button mechanisms for slidingly receiving one of said tangs of said latch plate and one of said arms of said at least one latch.

10. The non-inertial release restraint buckle assembly of claim 9 including a guide member secured to a buckle frame within said housing, said guide member including flange means for guiding said push button mechanisms within said housing.

11. The non-inertial release restraint buckle assembly of claim 9 wherein each of said push button mechanisms includes a cam surface oriented towards said second openings therein for selective engagement with one of said arms extending through said second opening to thereby cam said one of said arms to move said at least one latch from said first locked position thereof to said second release position thereof.

12. The non-inertial release restraint buckle assembly of claim 3 including first and second generally oppositely oriented latches mounted within said housing, each of said oppositely oriented latches having latch means extending therefrom for engaging within said opening of said latch plate when said latches are in said first locked position thereof, and separate first resilient means for urging each of said generally oppositely oriented first and second latches to said first locked position thereof.

13. The non-inertial release restraint buckle assembly of claim 12 in which each of said first and second latches includes at least two spaced latch means, said latch means of said first and second latches being interdigitated relative to one another within said opening of said latch plate when said first and second latches are in said first locked position.

14. The non-inertial release restraint buckle assembly of claim 12 in which each of said first and second latches include opposite side edges, each of said push button mechanisms includes an extension portion having a catch at an outer end thereof for engaging a remote edge of an adjacent one of said first and second latches, and said second resilient means including spring means extending from said extended portion of one of said push button mechanisms to the opposing push button mechanisms such that when any force is applied to one of said push button mechanisms an opposite force is applied to the extension portion of the opposite push button mechanism.

15. The non-inertial release restraint buckle assembly of claim 14 in which each of said push button mechanisms includes a cam surface mounted along a portion thereof for engaging an adjacent sidewall of one of said first and second latches to thereby cam said one of said first and second latches to said second release position thereof when said push button mechanisms are moved to said second inner release position thereof.

16. The non-inertial release restraint buckle assembly of claim 15 in which an edge of each of said first and second latches includes a beveled surface for cooperating with said cam surfaces of said push button mechanisms.

17. A method of providing a non-inertial safety restraint system for vehicles which system includes a latch plate having an opening therein, a buckle housing having an interior passageway for selectively receiving the latch plate and at least one latch movable within the housing from a first locked position engaging within an opening in the latch plate to retain the latch plate within the housing to a second release position to permit insertion and removal of the latch plate relative to the interior passageway of the housing, and wherein oppositely oriented release push button mechanisms are provided extending through openings in opposite sidewalls of the housing, the method including;

a) continuously urging the at least one latch to the first locked position thereof by a first resilient force, b) moving the at least one latch from the first locked position thereof to the second release position thereof against the first resilient force when the latch plate is being inserted within the housing and such that when the latch plate is fully inserted within the housing the at least one latch is moved by the first resilient force to the first locked position thereof to prevent withdrawal of the latch plate from the buckle housing, c) retaining the at least one latch in the first locked position thereof by applying a second resilient force between the oppositely oriented release push button mechanisms to engage the at least one latch to prevent movement of the at least one latch to the second release position thereof, and d) permitting release of the latch plate from the at least one latch only upon the simultaneous application of force to each of the push buttons to move said push buttons toward one another within the housing a against the second resilient force to thereby cause said at least one latch to be moved to the second release position thereof.

18. The method of claim 17 including the additional step of providing the second resilient force between the oppositely oriented push button mechanisms such that any force applied toward one of the push button mechanisms to move the one of the push button mechanisms to release the at least one latch applies an equal and opposite force simultaneously to the other of the push button mechanisms to urge the other of the push button mechanisms to remain in a position to prevent the at least one latch from moving to the second release position thereof.

19. The method of claim 17 including providing at least two oppositely oriented latches and providing first resilient forces to each of the at least two latches in opposite directions to thereby continuously urge the at least two latches toward their first locked positions to thereby retain the latch plate within the housing.

* * * * *